US007355352B2

(12) United States Patent
Deppe et al.

(10) Patent No.: US 7,355,352 B2
(45) Date of Patent: Apr. 8, 2008

(54) CIRCUIT AND METHOD FOR DYNAMIC ADJUSTMENT OF OPERATION CONDITIONS OF A GAS DISCHARGE LAMP

(75) Inventors: Carsten Deppe, Aachen (DE); Peter Lürkens, Aachen (DE); Gero Heusler, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/558,721

(22) PCT Filed: May 25, 2004

(86) PCT No.: PCT/IB2004/050770

§ 371 (c)(1),
(2), (4) Date: Nov. 30, 2005

(87) PCT Pub. No.: WO2004/107823

PCT Pub. Date: Dec. 9, 2004

(65) Prior Publication Data

US 2006/0238141 A1 Oct. 26, 2006

(30) Foreign Application Priority Data

Jun. 2, 2003 (EP) ..... 03101592

(51) Int. Cl.
*G05F 1/00* (2006.01)

(52) U.S. Cl. ..... 315/291; 315/307; 315/224; 315/247

(58) Field of Classification Search ..... 315/291, 315/307, 308, 297, 224, 225, 247, 246
See application file for complete search history.

(56) References Cited

U.S. PATENT DOCUMENTS 5,481,163 A * 1/1996 Nakamura et al. ..... 315/308
5,608,294 A 3/1997 Derra et al.
6,160,361 A * 12/2000 Giannopoulos et al. ..... 315/307
6,163,115 A * 12/2000 Ishizuka ..... 315/308
6,850,015 B2 * 2/2005 Ishizuka et al. ..... 315/224

FOREIGN PATENT DOCUMENTS

EP 1 152 645 A1 11/2001

* cited by examiner

*Primary Examiner*—Tuyet Vo

(57) ABSTRACT

A circuit and a method for operation of a gas discharge lamp includes a switching transformer having a switch, a converter, inductor and a controller in a control loop for measuring a lamp voltage and setting a desired power. The switching transformer further includes a second control loop used for adjusting the switching transformer to individual lamp conditions.

7 Claims, 5 Drawing Sheets

Figure 1:
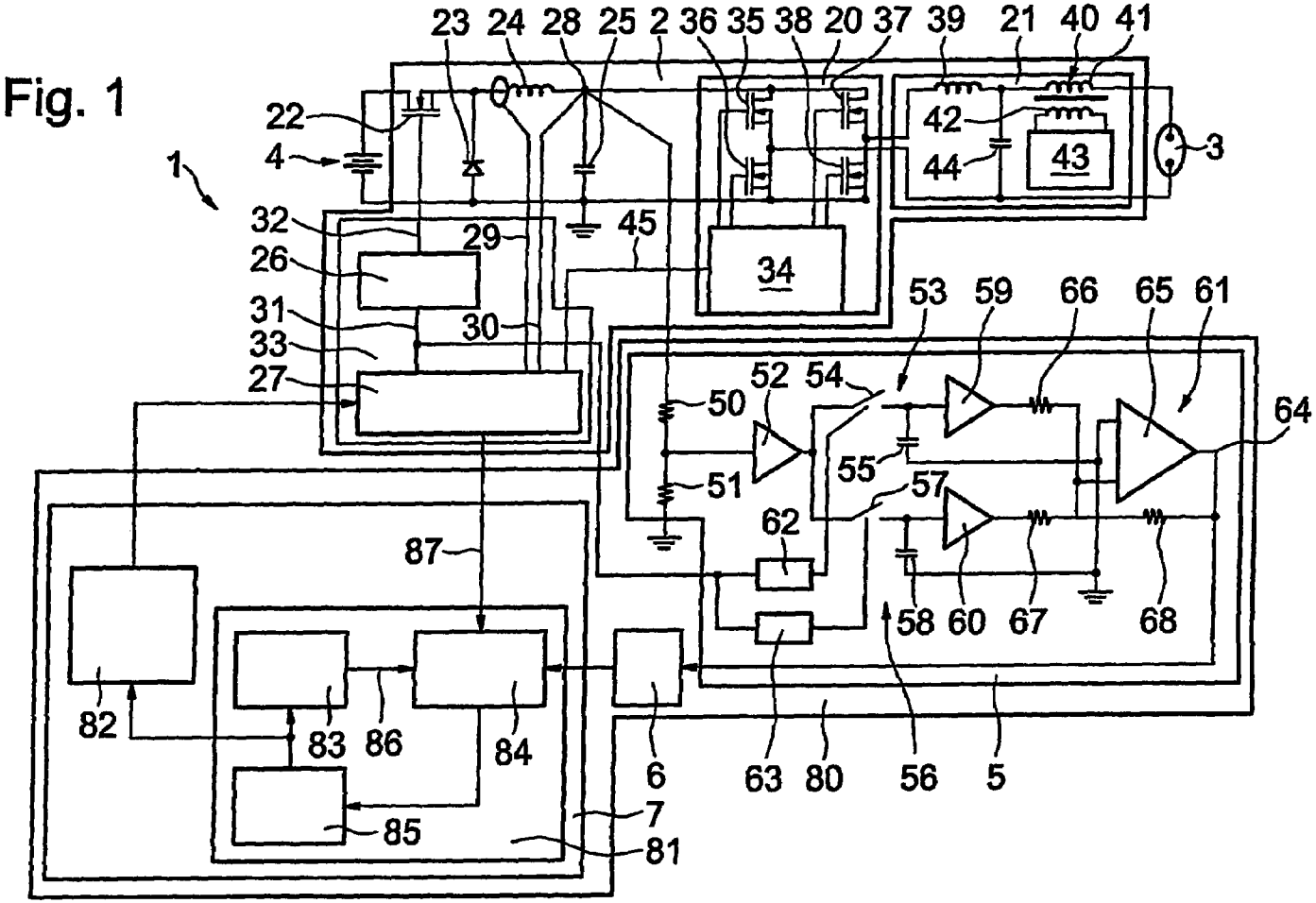

Fig. 2
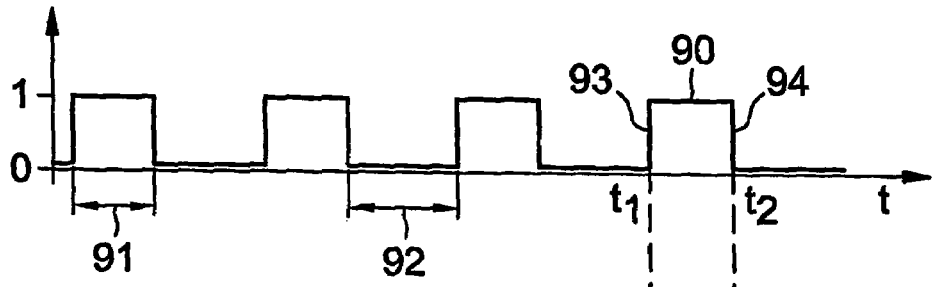
Fig. 3
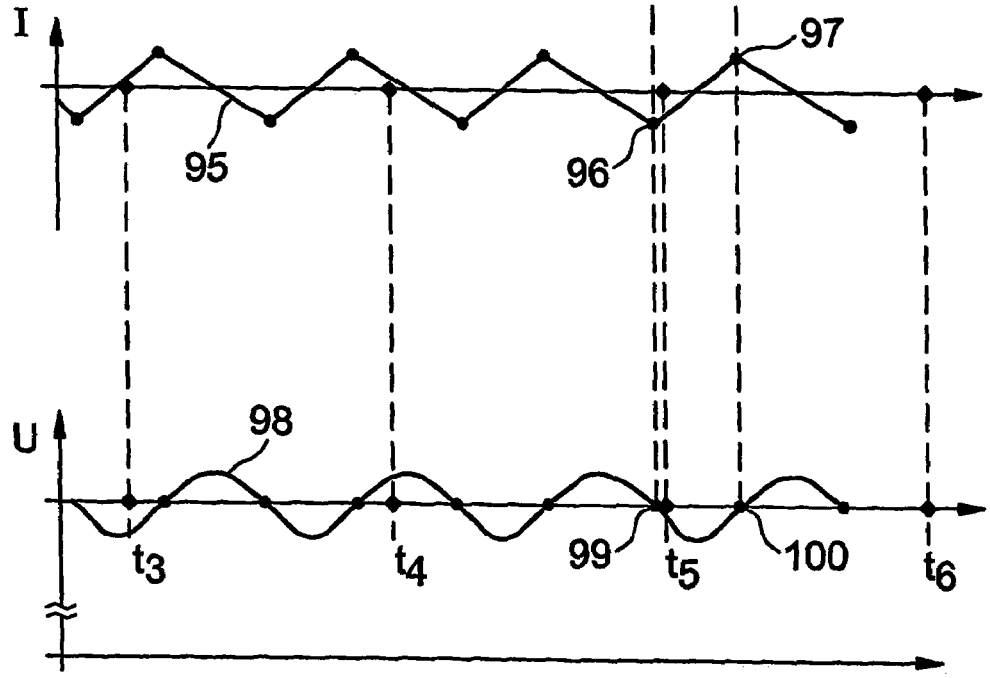
Fig. 4

CIRCUIT AND METHOD FOR DYNAMIC ADJUSTMENT OF OPERATION CONDITIONS OF A GAS DISCHARGE LAMP

The invention relates to a circuit and to a method for operation of a gas discharge lamp with a switching transformer, which switching transformer comprises a switch, a converter inductor and a control means in a control loop for measuring a lamp voltage and setting a desired power, and to a measuring filter for the circuit.

Such a circuit with a switching transformer is known from U.S. Pat. No. 5,608,294. The circuit comprises a rectifier, a commutating stage, a control means and a step-down transformer, also called a buck converter, with a switch and a converter inductor.

A method and a device for operating a gas discharge lamp of a data and video projector are known from EP 1 152 645 A1. In the case of an operation with alternating current or alternating voltage, electrodes of the gas discharge lamp are formable during operation, that is, structures grow on the electrodes of the gas discharge lamp. The size of the structures and the operating frequency of the current or the voltage are proportional to one another. The higher is the operating frequency, the smaller is the diameter of the grown structures. Tip structures can therefore be built up at the electrodes in such a way that, with an operating frequency sequence of 45, 65, 90 and 130 Hz, an operating voltage and an arc length can be reduced.

It is an object of the present invention to increase the service life of the lamp.

In accordance with the invention, the switching transformer comprises a second control loop. By means of the second control loop, the switching transformer can be adjusted to individual lamp conditions, a tendency of a plasma arc within the lamp to jump can be reduced, the electrode gap can be controlled and hence lumen output and the service life of the lamp are improved.

Advantageously, the control loop comprises a third inner control loop. By means of the third control loop, the individual lamp properties of the connected lamp can be determined. For that purpose, operational data measured at the lamp are compared with data already determined and parameters are adapted. In steady-state operation, the parameters are exactly the operational data of the connected lamp, and then it is possible specifically to influence the electrode gap and the electrode temperature in order to increase the lumen output and the service life of the lamp.

Advantageously, the third inner control loop comprises a computer circuit. The computer circuit has a calculated voltage waveform available at its output. The computer circuit is controlled in a simple manner by a commutation signal. The computer circuit and hence the third inner control loop require merely the commutation signal as a clock signal.

Advantageously, the third inner control loop comprises a memory. Parameters of the lamp are saved in the memory.

Advantageously, the second control loop comprises an integrating controller. Since the conditions in the lamp change only slowly, a slow and integrating controller is preferably used as controller.

Advantageously, the second control loop comprises a measuring filter. With two sample-and-hold stages of the measuring filter, a low-disturbance measurement of the lamp voltage is possible.

In a simple manner, the measuring filter comprises an adder, with which a mean value can be tapped from the measuring filter.

In a simple manner, the measuring filter is controlled by a clock signal. The measuring filter requires only the clock signal, which also switches the switch of the switching transformer on and off.

In accordance with the invention, values of at least one operational datum of the lamp varying with time is measured continuously or discontinuously, the measured operational data are compared with calculated operational data, parameters required for calculation are adjusted and a duty factor of a supply current is selected in dependence on the adjusted parameters.

In accordance with the invention, values of at least one operational datum of the lamp varying with time are measured continuously or discontinuously, the measured operational data are compared with calculated operational data, parameters required for calculation are adjusted and a frequency of an alternating voltage or an alternating current is selected in dependence on the adjusted parameters.

In accordance with the invention, values of at least one operational datum of the lamp varying with time are measured continuously or discontinuously, the measured operational data are compared with calculated operational data, parameters required for calculation are adjusted and a variable of a supply current, especially current pulses, is selected in dependence on the adjusted parameters. Values of at least one operational datum of the lamp varying with time are measured continuously or discontinuously and at the same time, from parameters assumed initially, hereinafter also referred to as starting parameters, operational data of the lamp are calculated alternately or serially and then the measured operational data are compared with the calculated operational data, new parameters are determined from this comparison and the parameters assumed initially are replaced by the determined parameters. In a transient, the determined parameters are compared until the best possible consistency has been achieved between calculated and measured parameters. Advantageously, in the steady state the duty factor, the frequency and the variable of the supply current are selected in dependence on the parameters in order to control the electrode gap and the electrode temperature.

A circuit with the inner control loop is used for analysis of the lamp and to indicate the individual lamp parameters.

These and other aspects of the invention are apparent from and will be elucidated with reference to the embodiments described hereinafter.

Figure 5:
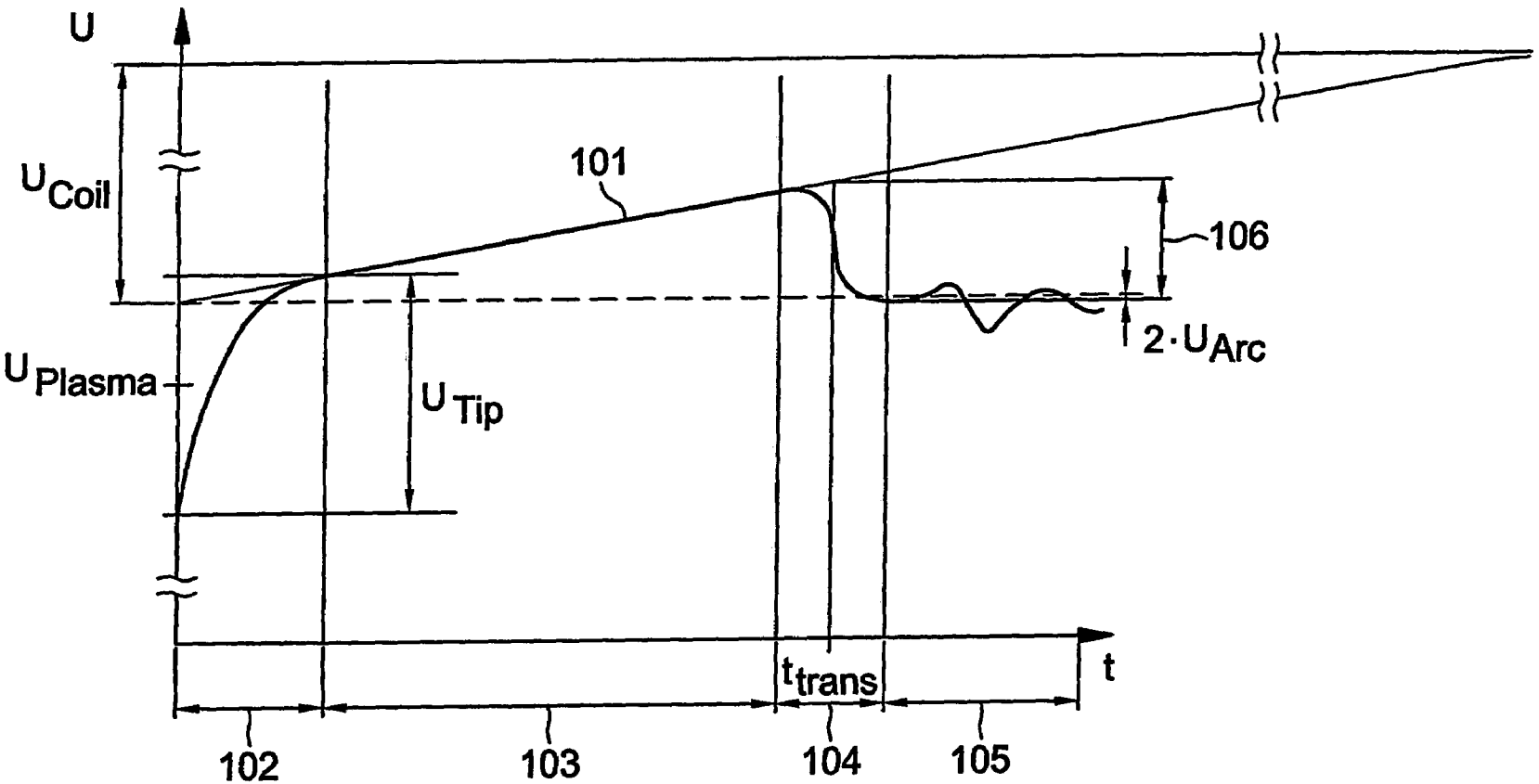
Figure 6:
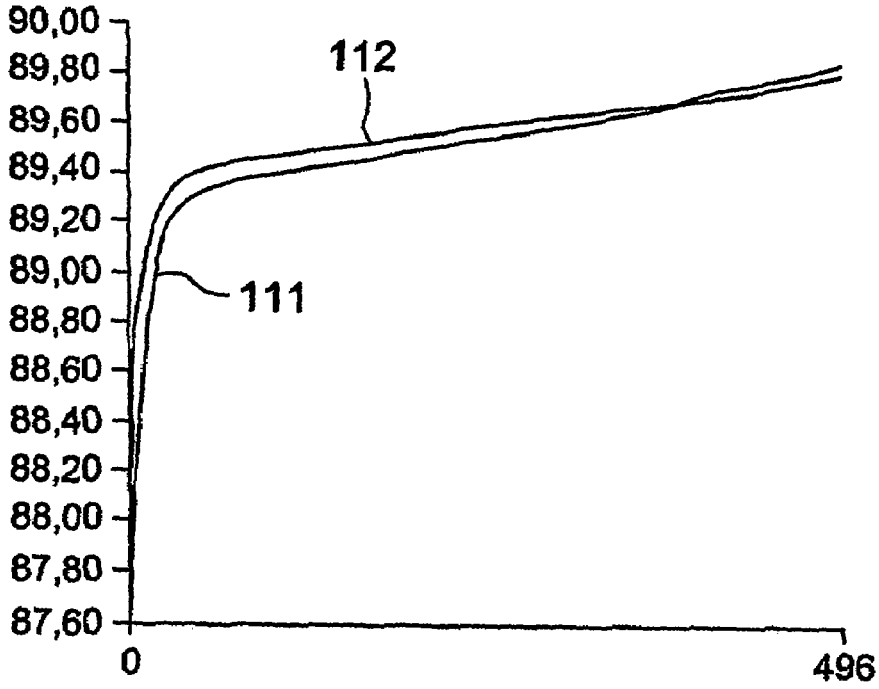
Figure 7:
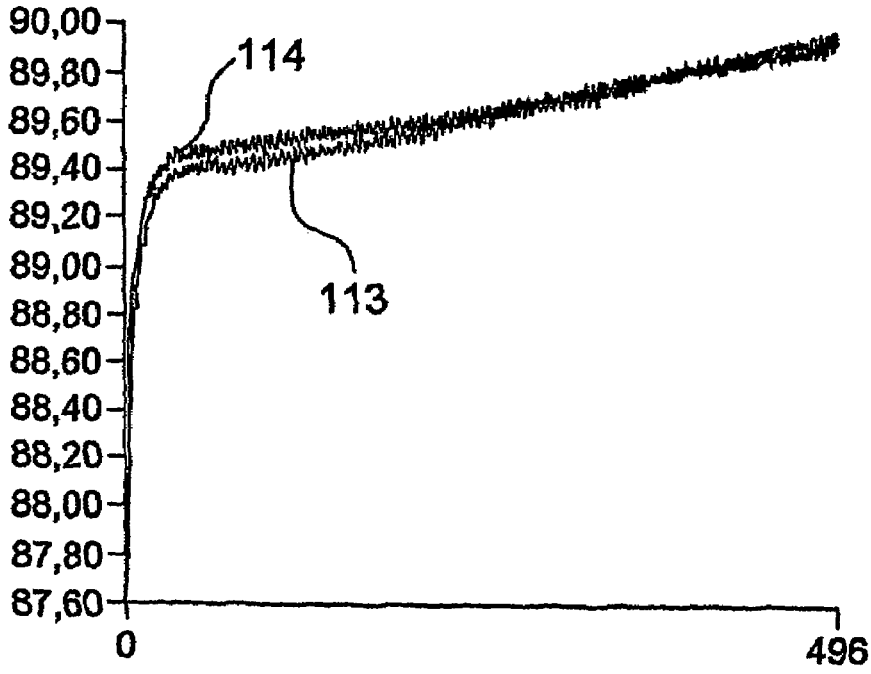

In the drawings:

FIG. 1 shows a block diagram with a switching transformer, a measuring filter and a control, FIG. 2 shows a timing diagram with a clock signal for switching on and off a switch of the switching transformer, FIG. 3 shows a timing diagram with a current waveform through a converter inductor of the switching transformer, FIG. 4 shows a timing diagram with a first voltage waveform at a gas discharge lamp for a half period, FIG. 5 shows a timing diagram with a second voltage waveform at a gas discharge lamp for a half period, FIG. 6 shows a timing diagram with calculated voltage values at the lamp for a first and a second half period, and FIG. 7 shows a timing diagram with measured voltage values at the lamp for a first and a second half period.

Figure 8:
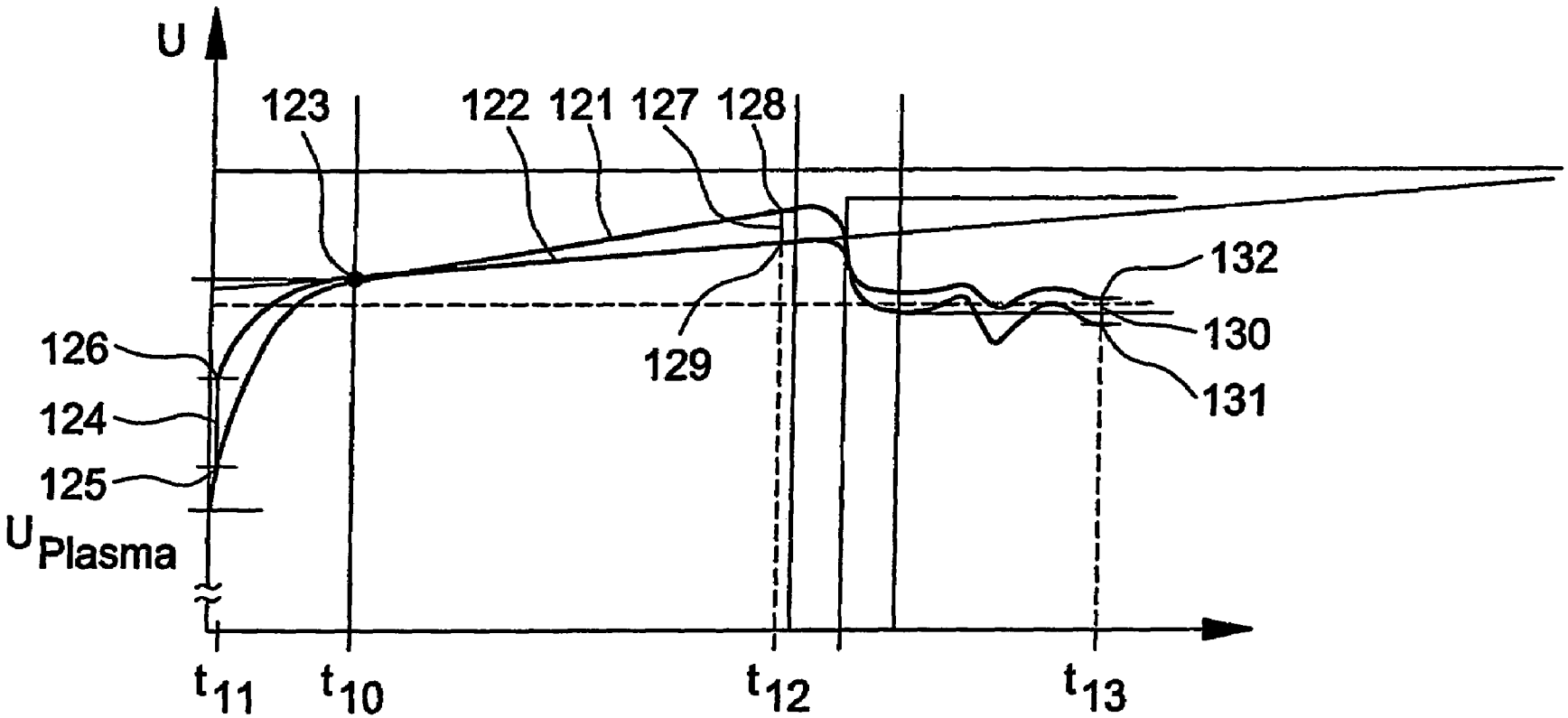

FIG. 8 shows a timing diagram with a measured and a calculated voltage waveform and intermediate difference values.

FIG. 1 shows a circuit 1 with a switching transformer 2, a gas discharge lamp 3, a dc voltage source 4 working as voltage supply, a measuring filter 5, an analog-digital converter 6, in the following also referred to as an A-D converter, and a control unit 7. The switching transformer 2 comprises a commutation stage 20, an ignition stage 21, a switch 22, a diode 23, a converter inductor 24, a capacitor 25, a converter 26, a control means 27 and a measuring point 28, between the converter inductor 24 and the commutating stage 20, at the capacitor 25. By means of electrically conductive connections 29 and 30, measured values can be tapped off at the converter inductor 24 and supplied to the control means 27. By way of further electrical connections 31 and 32 and the converter 26, the control means 27 controls the switch 22, also called switching transistor. The converter 26, the control means 27 and the electrically conductive connections 29, 30, 31 and 32 are parts of a first control loop 33. The commutation stage 20 comprises a commutation control unit 34 and four switching transistors 35, 36, 37 and 38. Depending on the signal state, the unit 34 switches on either 35 and 38 or 36 and 37. This controls the current direction in the lamp 3. The ignition stage 21 comprises a first inductor 39, an ignition transformer 40 with two coils 41 and 42, an ignition control unit 43 and a capacitor 44. The values of the capacitor 44 are small, so that in steady-state operation it is negligible. For an ignition, a switching signal of high frequency is present on an electrically conductive connection 45 to the commutation control unit 34, so that the inductor 39 and the capacitor 44 are excited by means of a resonant frequency. A high voltage of about 400 to 800 V occurs at the capacitor 44. At the same time, in the ignition control unit 43 a further small capacitor is charged up, which then supplies an ignition pulse to the ignition transformer 40. This generates a high voltage pulse of 5 to 25 kV at the lamp 3. The measuring filter 5 comprises a voltage divider 50, 51 with two resistors 50 and 51, an amplifier 52, a first sample-and-hold stage 53 with a switch 54 and a capacitor 55, a second sample-and-hold stage 56 with a switch 57 and a capacitor 58, a first impedance transformer 59, a second impedance transformer 60, an adder 61, two edge-triggered signal transmitters 62 and 63, also called triggers, and an output 64. By way of the electrically conductive connection 31 and the signal transmitters 62 and 63, the control means 27 controls the switches 54 and 57 of the sample-and-hold stages 53 and 56. The adder 61 works with an amplifier 65 and three resistors 66, 67 and 68.

The measuring filter 5, the A-D converter 6 and the control unit 7 are parts of a second control loop 80.

The control unit 7 comprises a third inner control loop 81 and a controller 82. The third inner control loop 81 comprises a computer circuit 83, a comparator circuit 84, hereinafter also referred to as a comparator, and a memory 85. At an output 86 of the computer circuit 83, in which a model formula with freely selectable parameters is realized, digitized values of a model voltage are available, which correspond to a model. By way of an electrically conductive connection 87, a signal that marks the time of the commutation is supplied to the comparator 84.

Output voltage and/or output current of the switching transformer 2 for the lamp 3 are/is adjusted by switching the switch 22 cyclically on and off. While the switch 22 is switched on, a voltage $U_{V1}$-$U_{C1}$ is present at the converter coil 24, which results from the voltage $U_{V1}$ of the dc voltage source 4 and the voltage $U_{C1}$ across the capacitor 25. The current in the converter inductor 24 consequently becomes greater. Since both $U_{V1}$ and $U_{C1}$ in first approximation are constant, the current rises linearly. On reaching a predetermined switching condition, the switch 22 is switched off, the current then flows via the diode 23. The voltage is then $-U_{C1}$, the current drops, again linearly. By means of the capacitor 25 and within the ignition stage 21, the voltage fluctuations are at least partially filtered.

During the transient response after switching on the circuit 1, the second control loop 80 is inactive. The current within the converter inductor 24 has fixed form, which is described by the relative amount of the current and the times of the current reversal. A boundary condition for the lamp 3 is a desired lamp power, which is also referred to as the desired value of the first control loop 33. The first control loop 33 therefore measures the lamp voltage and adjusts the absolute amount of the current such that the desired power is achieved. This method is repeated continuously at short intervals during the steady state operation of the lamp 3.

The third control loop 81, also referred to as the lamp observer, uses voltage values of the lamp 3 measured by time resolution, which are tapped off at the output 64 of the measuring filter 5. These are compared in the comparator 84 with the model voltage values calculated from the model formula. The model formula is also called model equation hereinafter. As a function of a difference between model voltage and measured voltage, the third control loop 81 then influences parameters of the model formula that are saved in the memory 85. After switching on the circuit 1, operating parameters of a new lamp are saved as starting parameters. During the transient response starting parameters set at the outset are brought into line with individual parameters of the connected lamp 3 and finally replaced by these. In other words: by means of the third control loop 81, the parameters saved in the memory 85 can be adapted to individual parameters of the connected lamp 3. A replica of the individual parameters is generated in the third control loop 81 and made available in the memory 85 for the second control loop 80. Thereafter, for optimizing the lamp operation, the individual parameters of the connected lamp 3 are taken into account in the second control loop 80. These individual parameters are then evaluated as operating parameters by the controller 82 and are used to determine an improved current waveform, an adapted desired power value or alterable current reversal times.

The first control loop 33 controls the lamp power to a set desired value. The second control loop 80 controls the mode of operation of the lamp 3 in response to the individual parameters of the lamp 3 or, in other words: the second control loop 80 controls the individual parameters of the lamp 3 by influencing the mode of operation. The third control loop 81 controls a stored replica of the starting parameters for optimum compliance with individual parameters of the connected lamp 3.

The adjustment by means of the controller 82 changes the values for desired power, current waveform and times of the current reversal stored in the switching transformer 2, hereinafter also called driver, specifically the values stored in the control means 27. The frequency is between 0.5 and 20,000 Hz, preferably between 30 and 1000 Hz. A pulse duration lies between 1 and 25% of the half cycle, preferably between 4 and 8%. Pulses and a pulsed operation are explained in detail inter alia in EP 1 152 645 A1. The relative pulse height lies between 0 and 1000% of the mean current, preferably between 100 and 400%, in absolute values this is 0 to 10 A, preferably 0.5 to 4 A, especially 2.6 A. The two successive periods in which the current flows first in one direction and then in the other direction through the lamp 3 are defined as duty factor. In normal operation, the duty factor is 50%, but a duty factor from 1 to 99% is possible, advantageously 20 to 80% at a power of 25 to 180 W, preferably 100 to 140 W at a nominal power of 120 W are used. For technical reasons, limits for the adjustment are set in dependence on the driver 2, the lamp 3 and a data and video projector used.

FIG. 2 shows a timing diagram with a clock signal 90 for a switched-on and a switched-off state of the switch 22 at times 91 and 92 and with a rising edge 93 at a time $t_1$ and with a falling edge 94 at a time $t_2$. The clock signal oscillates at a frequency of 50 KHz, that is, 20 μs per period or 1 ms for five periods.

FIG. 3 shows a timing diagram with a current signal 95 through the converter inductor 24. At the times $t_1$ and $t_2$, a minimum value 96 and a maximum value 97 of the current signal 95 are reached and the current changes its direction, the times $t_1$ and $t_2$ mark current reversal times.

FIG. 4 shows a sinusoidal voltage waveform 98 across the capacitor 25. When the switch 22 is switched on at the time $t_1$, a voltage value 99 is sampled in the sample-and-hold stage 53 and when the switch 22 is switched off at the time $t_2$ a second voltage value 100 is sampled. The two values 99 and 100 are tapped off via the voltage divider 50, 51 and values corresponding to the voltage divider 50, 51 are added up in the adder 61.

The first sample-and-hold stage 53 is thus triggered every time the switch 22 is switched on and therefore stores the value corresponding to the voltage value 99, while the converter current 95 reaches the minimum value 96. The second sample-and-hold stage is triggered when the switch 22 is switched off and stores the value corresponding to the value 100, while the converter current 95 reaches the maximum value 97. The adder 61 totals the two voltage values corresponding to the voltage divider 50, 51, and so a signal corresponding to a mean value can be tapped off at the output 64 at each time $t_3$, $t_4$, $t_5$ and $t_6$. This signal can then be used at any of the times $t_3$-$t_6$, that is, asynchronously, and with any sampling rates. A low-disturbance measurement of the voltage at the capacitor 25 is thus achieved here, and a measured value can be tapped of if without disturbances through the switching transformer 2.

As input signals, the measuring filter 5 requires merely the variable to be measured, which is tapped off at the measuring point 28 and across the voltage divider 50, 51, and the switching signal of the switching transistor 22 of the switching transformer 2, which is tapped off before the converter 26. The signal 98 to be measured is first stabilized by a first amplifier stage 52 working as impedance transformer, so that the adjoining sample-and-hold stages 55 and 58 are able to operate reliably. With a rising edge 93 of the switching signal on the electrically conductive connection 31 out of the switching transformer 2, the trigger 62 generates a short pulse, which briefly switches on the switch 54. The capacitor 55 is charged to the voltage value present at this time. An impedance transformer 59 follows behind the capacitor 55. The capacitor 55 is consequently closed at very high resistance and subsequently holds this voltage value constant. The same process is performed by the trigger 63, the switch 57, the capacitor 58 and the impedance transformer 60 at the falling switching edge 94. Thus, at any time, values are available that correspond to the values 99, 100 measured at the time that the switch 22 is switched on and off. These values are subsequently added by the further amplifier 65 and the resistors 66, 67 and 68 and made available at the output 64 for further use.

The gas discharge lamp 3, especially a high-pressure gas discharge lamp, known as a high intensity discharge lamp or HID-lamp for short, is operated with a square-wave alternating current. In particular, an extra-high pressure gas discharge lamp is used, also called an ultra high pressure, ultra high performance or UHP lamp for short. The voltage at the lamp is in this case likewise approximately rectangular. If, however, the waveform of the voltage is examined more closely, a characteristic variation from the rectangle is revealed. This variation is primarily caused by the behavior of the plasma arc at the cathode, and in particular, the variation is dependent on an area with which the plasma arc joins to the cathode. By measuring and evaluating the voltage waveform, on the assumption that the lamp is intact, it is possible to determine the individual parameters of the lamp 3 that reflect the conditions within the gas discharge lamp, such as electrode gap, relative temperature of the two electrodes, in each case for the electrode working in a half period as the cathode, geometrical shaping of the electrode tip, melting state of the electrodes, area change of the cathode arc attachment point and jump tendency of the plasma arc.

Considerations here are based on the fact that the lamp voltage consists of a voltage drop on supply conductors and in the electrode material as ohmic resistance, an approximately constant voltage drop at the anode, a voltage drop influenced by the emission behavior of the electrode and resulting arc state in front of the cathode, and a plasma voltage across the actual arc discharge dependent on pressure, plasma temperature and arc length.

FIG. 5 shows a voltage waveform 101 over the time t, which is divided into four regions 102, 103, 104 and 105. The voltage waveform 101 in the first region 102 is determined substantially by the shape of the electrode tip. The voltage in this region 102 is therefore referred to as $U_{Tip}$, an associated time value as $\tau_{Tip}$. The voltage waveform 101 in the second region 103 is determined substantially by the temperature of the thickened part of the electrode wound with a tungsten coil. The voltage in this region 103 is therefore referred to as $U_{Coil}$, and an associated time value as $\tau_{Coil}$. The voltage waveform 101 in the third region 104 is determined substantially by the change in the arc attachment at the cathode and describes a transition of the electrons from the cathode into the plasma arc. Characteristics of this region 104 are therefore provided with the addition "trans". The voltage waveform 101 in the fourth region 105 is determined in that the arc attachment can be constricted to a spot. The arc attachment therefore changes from a diff-use two-dimensional attachment to a point-form attachment constricted to a spot. Characteristics of this fourth region 105 are therefore provided with the description "spot". The third and fourth regions do not occur in every case.

In general, this waveform 101 can be described by the following formula:

$$U_{(n)} = U_{Plasma} - 2 * U_{Arc} + U_{Tip} * \left[0.5 - e^{-\left(\frac{n*\Delta t}{\tau_{Tip}}\right)}\right] + \left[U_{Coil} * \left(1 - e^{-\left(\frac{n*\Delta t}{\tau_{Coil}}\right)}\right) + U_{Arc}\right] * \left[1 - \tanh\left(S_{Trans} * \left[n - \frac{t_{Trans}}{\Delta t}\right]\right)\right]$$

A voltage difference 106 can be described by a term:

$$2 * \left[U_{Coil} * \left(1 - e^{-\left(\frac{t_{Trans}}{\tau_{Coil}}\right)}\right) + U_{Arc}\right]$$

The free parameters $U_{Plasma}$, $U_{Tip}$, $U_{Coil}$, $\tau_{Tip}$, $U_{Arc}$, $t_{Trans}$ and $S_{Trans}$ are saved in the memory 85 and are adjusted by means of the inner control loop 81.

The formula is converted in the computer circuit 83 with n as the number of the sampling value, which starts at 0 at every polarity change, and $\Delta t$ is the time between two sampling values. $\Delta t$ lies preferably between 5 and 200 μs, in this case at 10 μs. The duration $\tau_{Coil}$ is fixed at 100 ms. $\tau_{Tip}$ and $\tau_{Coil}$ are first order time constants.

The formula consists of four summands. The first summand $U_{Plasma}$ is represented in the first region 102 and is of an order of magnitude between 55 V and 130 V; 75 V are typical of a new lamp. $U_{Plasma}$ is characteristic of the electrode gap, which with a new lamp is around 1 mm, and of the voltage drop across the anode. The second summand $-2\ U_{Arc}$ is a correction value, which results in conjunction with the fourth summand ($U_{Coil}$* . . . )*(1-tanh( . . . )). The third summand $U_{Tip}$*(0.5 . . . ) describes the function in the first region 102. $U_{Tip}$ lies in a range from 0 V to 6 V, 1.5 V being typical of a new lamp. $U_{Tip}$ is characteristic of the rounding of the electrode tip.

The fourth summand describes the two regions 103 and 104, $U_{Coil}$ marking a voltage value in the regions 103 and 104 and lying in the order of magnitude between 0 V and 65 V, 5 V being typical of a new lamp. The smaller is $U_{Coil}$, the higher is the temperature. $\tau_{Tip}$ lies in a range between 30 μs and 500 μs, 150 μs being typical of a new lamp. $\tau_{Tip}$ is characteristic of the rounding of the tip. $U_{Arc}$ lies in a range between −2 V and 2 V and is a correction factor. $t_{Trans}$ lies in a range between 0.1 ms and the end of the rectangle. If $t_{Trans}$ does not occur, then no spot attachment to the cathode occurs. $S_{Trans}$ is the steepness in the region 104, lies in a range between 0.01 and 10 and is characteristic of the transition of the arc attachment. These parameters are adjustable by means of the inner control loop 81. Alternatively, these parameters can also be adapted by a program.

A resonant frequency $f_{resonance}$ between 1,500 and 7,000 Hz characterizes a possibly present molten tip and at 10,000 Hz the electrode tip is completely solidified. For a new lamp, the resonant frequency is around 5,000 Hz. A resonance is indicative of magnitude and volume of a molten tip and hence at the same time also of the temperature. The resonance is determined directly by analysis of the lamp voltage in the frequency range.

After a current reversal, a plasma arc is present at first over a wide area, that is, diffusely, at a cathode of the gas discharge lamp 3. In the region 104, the plasma arc changes from the wide-area state acting on the cathode to the spot-form state acting on the cathode. The jump function in the third region 104 stands for this change in the arc state at the cathode. The plasma arc continues to act on the anode over a wide area.

Specific portions of the lamp voltage waveform 101 are thus closely linked with the inner state of the lamp 3. These portions can be separated from one another substantially by their time response: waveform immediately after commutation, reproduced in region 102 with the summand $U_{Tip}$ * (0.5−e . . . ), slope, reproduced in the region 103 with the summand $U_{Coil}$, mean voltage, reproduced by $U_{Plasma}$. In order to utilize these conditions, relatively small voltage variations, which are superimposed on the square-wave voltage, are to be measured and assigned to the lamp parameters.

The formula within the computer circuit 83 can be changed by means of the variable parameters. During operation, the voltage values at the lamp are measured, filtered in the measuring filter 5, digitized in the A-D converter and compared with digital values from the computer circuit 83 present at the output 86. By calculations, new parameters for the memory 85 can be determined from the error thus determined. The calculation is carried out section-wise for a half period each time.

The switching transformer 2, hereinafter also called the lamp driver, supplies the lamp 3. For that purpose, it generates a current waveform programmed in the control means 27. The driver 2 supplies the commutation clock signal to the computer circuit 83. As parameters, the memory 85 contains actual characteristics of the connected lamp 3. In the first pass, these are the typical values of a new lamp 3, or in other words: initially set parameters are parameters of a new lamp (3). The computer circuit 83 makes the model voltage available at the output 86. This is the voltage waveform that a lamp 3 with the given parameters and current values ought to have. The actual lamp voltage is tapped off at the lamp 3, measured and compared in the comparator circuit 84 with the model voltage, that is, the calculated waveform. The comparator circuit 84 sends a correction signal, which represents a variation between the model voltage and the measured value, to the memory 85. By means of the correction signal, the parameters inside the memory 85 can be corrected. The model voltage can thus be better matched to the actual lamp voltage in each pass. In steady-state operation, the parameters inside the memory 85 are exactly those of the connected lamp 3.

Control values, which are likewise stored in the memory 85 and activate the controller 82, can be derived from the parameters. The computer circuit 83, the comparator circuit 84, the memory 85 and the controller 82 are alternatively realizable also as μC or as signal processor or are integrable in the control unit 27 in order to optimize the lamp operation or to detect faults.

In the low frequency range, the lamp 3 behaves in first approximation like a constant reverse voltage. That is, the voltage at the lamp 3 is independent of current to the greatest possible extent. Only the direction of the voltage changes with the current direction. On being fed with a square-wave alternating current, exactly the same square-wave voltage is obtainable. Superimposed on this is a small voltage varying with time, which is essential for the model formation. The electrodes operate alternately per half period as cathode.

FIG. 5 illustrates the typical course of the absolute value of the lamp voltage. The voltage is described by means of the two time constants $\tau_{Tip}$ and $\tau_{Coil}$ and comprises the step behind which the voltage adjusts to a low value. The overall effect has an amplitude of a few percent of the total voltage. Occasionally, an oscillation of small amplitude ensues. The parameters for the formula are then the two time constants $\tau_{Tip}$ and $\tau_{Coil}$, shape and position of the step and an amplitude of a possible resonance. The formula additionally contains the voltage value $U_{Plasma}$ for the components arc drop and anode drop, which is a measure of the electrode gap. The first relatively short time constant $\tau_{Tip}$ provides information about the shape of the tip region of the electrode. The second time constant $\tau_{Coil}$ describes the electrode temperature or the emission. A resonance indicates magnitude and volume of a molten tip and hence at the same time also the temperature.

In the inner control loop 81, a method is realized with which the waveform of the lamp voltage is analyzed over a period of the lamp current. Different internal states of the lamp, such as electrode temperature, arc state, electrode gap and melting state of the electrodes produce characteristic signatures in the periodic voltage waveform of the lamp. By comparing the measured lamp voltage waveform with these characteristic waveforms, which have been obtained in advance, inferences can be drawn about the internal states of the lamp 3 during operation.

From an analysis of the parameters, different requirements for the lamp current can be determined.

An increasing electrode gap can be counteracted by adding a current pulse or increasing an already existing current pulse before a commutation. A reduction in or switching off the current pulse before the commutation halts a diminishing electrode gap. A current pulse after the commutation likewise halts a diminishing electrode gap or increases an electrode gap.

The parameters for a relative temperature, tip shape and melting state are closely interdependent, an identical temperature for both electrodes with molten, round tip is favorable. This adjustment and balance can be undertaken by an alteration of the respective pulse amplitudes.

In other projectors, a constant light current without pulse trains is often demanded.

A balanced temperature for both electrodes, so that an identical tip shape and an identical melting state is reached, is achievable by adjusting the ratio of the duration of positive and negative lamp current half-wave of the alternating current.

On the basis of a frequency increase, the intervals between two successive polarity changes become smaller. The jump function has approximated to the following polarity change and the region 105 is kept small in an advantageous manner. An unfavorable time characteristic of the diameter of the cathode arc attachment is thus compensated by a frequency increase of the frequency. At relatively high frequency, the jump function no longer occurs.

A relatively low electrode temperature is achievable by means of a relatively low lamp power. For that purpose, the temperature of the two electrodes is derived from the parameter $U_{Coil}$.

The method is used to hold the load on the electrodes constant in a narrow range. By this means, the service life of the lamp can be extended, in particular the operational phase with optimum lumen output can be extended. An optimum lumen output is achieved when a short electric arc is produced at a constant arc interval.

FIG. 6 shows a first voltage waveform 111 for voltage values calculated in a first half-period and a second voltage waveform 112 for voltage values calculated in a second half-period for a 120 W Philips UHP lamp having a nominal electrode gap of 1 mm and a nominal pressure of 230 bar. In the first half-period, the first electrode acts as cathode, and in the second half-period, the second electrode acts as cathode.

FIG. 7 shows a third voltage waveform 113 for voltage values measured in a first half-period and a second voltage waveform 114 for voltage values measured in a second half-period for the same lamp having a nominal electrode gap of 1 mm and a nominal pressure of 230 bar. The waveforms 113 and 114 are zigzag shaped because of interference.

The waveforms 111 and 112 are each attributed to the respective electrode operating in a half-period as cathode. For evaluation of this form, the model function is used, the parameters of which are adjusted by the program in the computer circuit 83 so that it corresponds as exactly as possible to the measured waveform. As parameters for the first electrode, $U_{Plasma}$ is specified with 88.54 V, $U_{Tip}$ is specified with 1.61 V, $U_{Coil}$ with 6.13 V, $\tau_{Tip}$ with $1.0*10^{-4}$s, $U_{Arc}$ with 0.33 V, $\tau_{Trans}$ with $4.97*10^{-3}$s, $S_{Trans}$ with 0.03 and $f_{resonance}$ with 10,000.00 Hz. As parameters for the second electrode, $U_{Plasma}$ is specified with 88.56 V, $U_{Tip}$ with 1.76 V, $U_{Coil}$ with 4.69 V, $\tau_{Tip}$ with $1.0*10^{-4}$ s, $U_{Arc}$ with 0.26 V, $\tau S_{Trans}$ with 0.03 and $f_{resonance}$ with 10,000.00 Hz.

A value of 88.5 V for $U_{Plasma}$ is valid for an already somewhat older lamp 3 that has been operating for a longer period of time, the electrode gap of which has enlarged due to vaporization. The lamp 3 is operated at a frequency of 100 Hz, one half-period is therefore 5 ms long. A time characteristic over 4.97 ms is shown, because several front and rear sampling values have been suppressed as protection against interference. Values greater than 1 V for $U_{Tip}$ indicate a still slightly rounded electrode tip. Increasing values for $U_{Coil}$ signify a colder electrode. In the case of a voltage waveform 111 of the first electrode having a stronger increase than a voltage waveform 112 of the second electrode, it is clear that the first electrode is somewhat colder than the second electrode. Smaller time constants for $\tau_{Tip}$ indicate flatter electrode tips. $U_{Arc}$ is the correction value. A time of the change between the diffuse and the spot state of the arc in the region 104 is denoted by $t_{Trans}$. A measuring interval for the regions 102 and 103 is reproduced, with 496 measured values at intervals of 10 μs, this corresponds to 4.97 ms. The steepness of the spot transition is denoted by $S_{Trans}$. A resonant frequency $f_{resonance}$ between 1,500 and 7,000 Hz signifies a possibly melted tip and at 10,000 Hz the electrode tip is completely solidified.

In order to compensate for uneven electrode temperatures, use is made of the effect determined by physics that the electrode is heated more strongly in the anode phase than in the cathode phase. By adapting the ratio of the duration of the anode phase to the duration of the cathode phase, the heat output can therefore be shifted between the two electrodes. For that purpose, in the control loop 81, the $U_{Coil}$ values of the two electrodes are compared and the duty factor of the supply current can be shifted until the two temperature values are the same. Since the conditions in the lamp change only slowly, a slow and integrating controller is preferably used as controller 82. With a first phase of the alternating current and the first electrode as anode at a duty factor of 50% as starting value or at a stored duty factor from a preceding operation, a simplified sequence for a program sequence is as follows: firstly compare $U_{Coil}$ of the two electrodes 1 and 2, secondly, if $U_{Coil,E1}$ is greater than $U_{Coil,E2}$, then increase the duty factor by 0.01%, or secondly, if $U_{Coil,E1}$ is smaller than $U_{Coil,E2}$ then reduce the duty factor by 0.01%, or if $U_{Coil,E1}$ is the same as $U_{Coil,E2}$ then increase or reduce the duty factor by 0.01% towards 50%, then wait one second and repeat the process. This method permits the automatic compensation of temperature differences conditional upon manufacturing tolerances as well as upon installation or mounting, and can therefore prolong the service life of the lamp. At the same time, a vertical operating position of the lamp can be taken into account.

FIG. 8 shows a measured voltage waveform 121 and a calculated voltage waveform 122. $U_{Plasma}$ of the measured voltage waveform is now set so that the two waveforms 121 and 122 have a common intersection 123 at the time $t_{10}$. Then, at the time $t_{11}$, a difference 124 between the measured voltage value 125 and the calculated voltage value 126 is measurable for adjustment of $U_{Tip}$. At the time $t_{12}$, a difference 127 between the measured voltage value 128 and the calculated voltage value 129 is measurable for adjustment of $U_{Coil}$, and at time $t_{13}$ a difference 130 between the measured voltage value 131 and the calculated voltage value 132 is measurable for adjustment of $U_{Arc}$. At times that lie close to or further away from the times $t_{11}$, $t_{12}$ and $t_{13}$, values that are used for monitoring are measured. The measured voltage values 125, 128 and 131 are operational data of the lamp.

LIST OF REFERENCE NUMBERS

1 Circuit
2 Switching transformer
3 Gas discharge lamp
4 Voltage supply
5 Measuring filter
6 A-D converter
7 Control unit
8
9
10
11
12
20 Commutation stage
21 Ignition stage
22 Switch
23 Diode
24 Converter inductor
25 Capacitor
26 Converter
27 Control
28 Measuring point
29 Electrically conductive connection
30 Electrically conductive connection
31 Electrically conductive connection
32 Electrically conductive connection
33 First control loop
34 Commutation control unit
35 Switching transistor
36 Switching transistor
37 Switching transistor
38 Switching transistor
39 First inductor
40 Ignition transformer
41 Coil
42 Coil
43 Ignition control unit
44 Capacitor
45 Electrically conductive connection
46
50 Voltage-divider/resistor
51 Voltage-divider/resistor
52 Amplifier
53 First sample-and-hold-stage
54 Switch
55 Capacitor
56 Second sample-and-hold stage
57 Switch
58 Capacitor
59 Impedance converter
60 Impedance converter
61 Adder
62 Edge-triggered signal transmitter
63 Edge-triggered signal transmitter
64 Output
65 Amplifier
66 Resistor
67 Resistor
68 Resistor
69
80 Second outer control loop
81 Third inner control loop
82 Controller
83 Computer circuit
84 Comparator
85 Memory
86 Output
87 Electrically conductive connection
90 Clock signal
91 Switched-on state
92 Switched-off state
93 Rising edge
94 Falling edge
95 Current/Voltage signal
96 Minimum value
97 Maximum value
98 Voltage waveform
101 Voltage waveform
102 Region
103 Region
104 Region
105 Region
106 Voltage difference
111 Calculated voltage waveform 1.Hp
112 Calculated voltage waveform 2.Hp
113 Measured voltage waveform 1.Hp
114 Measured voltage waveform 2.Hp
121 Measured voltage value
122 Calculated voltage value
123 Intersection
124 Difference value
125 Operational datum/measured voltage value
126 Calculated voltage value
127 Difference value
128 Operational datum/measured voltage value
129 Calculated voltage value
130 Difference value
131 Operational datum/measured voltage value
132 Calculated voltage value

The invention claimed is:

1. A method for operation of a gas discharge lamp with a switching transformer, wherein the switching transformer comprises a switch, a converter inductor and a control means in a control loop for measuring a lamp voltage and setting a desired power, the method comprising the acts of:

measuring values of at least one operational datum of the lamp varying with time, comparing the measured operational data with calculated operational data, adjusting parameters necessary for calculation, said parameters including at least one of rise time and steepness of regions of a measured lamp waveform, and selecting a duty factor of a supply current in dependence on the adjusted parameters.

2. The method as claimed in claim 1, wherein initially set parameters are parameters of a new lamp.

3. The method as claimed in claim 1, wherein the parameters are storage in a memory.

4. The method as claimed in claim 1, wherein in steady-state operation the parameters inside the memory are exactly those of the connected lamp.

5. A data and video projector having a circuit for implementing a method as claimed in claim 1.

6. The method of claim 1, further comprising the act of selecting a frequency of an alternating voltage or an alternating current in dependence on the adjusted parameters.

7. The method of claim 1, further comprising the act of selecting a value of a supply current in dependence on the adjusted parameters.

* * * * *